US011551606B2

(12) United States Patent
Kim et al.

(10) Patent No.: US 11,551,606 B2
(45) Date of Patent: Jan. 10, 2023

(54) LED DRIVING CIRCUIT, DISPLAY PANEL, AND PIXEL DRIVING DEVICE

(71) Applicant: LX Semicon Co., Ltd., Daejeon (KR)

(72) Inventors: Kyoung Tae Kim, Daejeon (KR); Myeong Hak Lee, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/545,974

(22) Filed: Dec. 8, 2021

(65) Prior Publication Data

US 2022/0199001 A1 Jun. 23, 2022

(30) Foreign Application Priority Data

Dec. 18, 2020 (KR) ..... 10-2020-0178856

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0809* (2013.01); *G09G 2300/0876* (2013.01)

(58) Field of Classification Search
CPC ... G09G 3/32–3291; G09G 2300/0809; G09G 2300/0876
See application file for complete search history.

(56) References Cited

U.S. PATENT DOCUMENTS

| | | | | |
|---|---|---|---|---|
| 9,633,606 | B2 | 4/2017 | Lee et al. | |
| 10,714,008 | B1 * | 7/2020 | Lu | G09G 3/3233 |
| 2015/0170579 | A1 | 6/2015 | Lee et al. | |
| 2020/0211448 | A1 | 7/2020 | Zhou | |
| 2021/0225262 | A1 | 7/2021 | Liu | |

FOREIGN PATENT DOCUMENTS

| | | | |
|---|---|---|---|
| KR | 10-0634752 | B1 | 10/2006 |
| KR | 10-1334268 | B1 | 12/2013 |
| KR | 10-1472124 | B1 | 12/2014 |
| KR | 10-2020-0135524 | A | 12/2020 |

* cited by examiner

*Primary Examiner* — Gene W Lee

(74) *Attorney, Agent, or Firm* — Fenwick & West LLP

(57) ABSTRACT

Embodiments relate to display panel and pixel driving device techniques. A hybrid scheme is provided in that a PWM (pulse width modulation) scheme, in which a ramp voltage is supplied as a gate voltage of a transistor and an LED is turned off at a time point when the gate voltage becomes the same as a threshold voltage, and a PAM (pulse amplitude modulation) scheme, in which a start voltage of the ramp voltage is determined depending on a gray scale value of a pixel, are combined.

19 Claims, 12 Drawing Sheets

LED DRIVING CIRCUIT, DISPLAY PANEL, AND PIXEL DRIVING DEVICE

CROSS REFERENCE TO RELATED APPLICATION

This application claims priority from Korean Patent Application No. 10-2020-0178856, filed on Dec. 18, 2020, which is hereby incorporated by reference for all purposes as if fully set forth herein.

BACKGROUND

1. Technical Field

The present disclosure relates to a technique regarding a display panel and a pixel driving device.

2. Related Art

With the development of informatization, various display devices capable of visualizing information are being developed. A liquid crystal display (LCD), an organic light emitting diode (OLED) display device and a plasma display panel (PDP) display device are display devices which have been developed so far or are being developed. These display devices are being developed to appropriately display high-resolution images.

However, the above-described display devices have the advantage of high resolution, but are at a disadvantage that the display devices are difficult to make larger in size. For example, large OLED display devices developed so far have only sizes of 80 inches (about 2 m) and 100 inches (about 2.5 m). Therefore, they are not suitable for fabricating a large display device with a width of more than 10 m.

As a method for solving such a problem in terms of large size, interest in a light emitting diode (LED) display device is increasing recently. In an LED display device technique, as a required number of modularized LED pixels are disposed, one large panel may be configured. Otherwise, in an LED display device technique, as a required number of unit panels each of which is configured by a plurality of LED pixels are disposed, one large panel structure may be formed. As such, in the LED display device techniques, by disposing LED pixels by increasing the number thereof as many as required, a large display device may be easily realized.

The LED display device has the advantages of not only a large size but also various panel sizes. In the LED display device techniques, it is possible to variously adjust horizontal and vertical sizes according to appropriate disposition of LED pixels.

Meanwhile, there may be various schemes of driving a display panel in which LEDs are disposed. As representative schemes, there are a pulse amplitude modulation (PAM) scheme and a pulse width modulation (PWM) scheme. The PAM scheme is a scheme in which an analog voltage corresponding to a gray scale value of a pixel is supplied to the pixel and the magnitude of a current flowing to the pixel is differently controlled depending on the analog voltage, and has a problem in that it is difficult to implement a low gray scale in a display panel in which LEDs are disposed. The PWM scheme is a scheme in which a time of a current supplied to a pixel is adjusted depending on a gray scale value of the pixel. In the conventional active scheme, since a comparator circuit should be disposed in the pixel, a problem is caused in that the structure of the pixel is complicated and accuracy is not uniform due to an offset of a comparator.

SUMMARY

Under such a background, in one aspect, the present disclosure is to provide a technique for easily implementing a low gray scale in a display panel in which LEDs are disposed. In another aspect, various embodiments are directed to providing a technique for driving a pixel in a PWM scheme without using a comparator. In still another aspect, various embodiments are directed to providing a hybrid pixel driving technique in which a PAM scheme and a PWM scheme are combined.

To this end, in one aspect, the present disclosure provides a light emitting diode (LED) driving circuit, which drives an LED disposed in a pixel, comprising: a first path circuit comprising a first transistor and a second transistor which are disposed in series between a driving high voltage and a driving low voltage and a first node formed between the first transistor and the second transistor; and a second path circuit comprising a third transistor which is disposed in series with the LED between the driving high voltage and the driving low voltage, a gate of the third transistor being electrically connected to the first node, wherein a ramp voltage which increases or decreases with the lapse of time is supplied to a gate of the second transistor, and a start voltage of the ramp voltage is determined depending on a gray scale value of the pixel.

The LED may be turned off at a time point when a gate-source voltage of the second transistor becomes the same as a threshold voltage of the second transistor after increasing or decreasing depending on the ramp voltage.

A control time for the pixel may be divided into an initialization time, a program time and a light emission control time; an initial voltage according to a gray scale value of the pixel may be written into the pixel during the program time; and the start voltage may be set depending on the initial voltage at an initial stage of the light emission control time.

A capacitor may be disposed between the gate of the second transistor and a data line and the initial voltage may be written into the capacitor during the program time.

A data voltage supplied to the data line may be changed to a predetermined voltage at the initial stage of the light emission control time, and thereafter, the level of the data voltage may increase or decrease with a predetermined slope.

In another aspect, the present disclosure provides a display panel, in which a plurality of pixels are disposed, each pixel, comprising: a first path circuit comprising a first transistor which controls a supply of a driving high voltage to a first node and a second transistor which controls a supply of a driving low voltage to the first node; and a second path circuit comprising a third transistor which controls a supply of the driving high voltage to an anode of an LED and a fourth transistor which controls a supply of the driving low voltage to a cathode of the LED, a gate of the third transistor being connected to the first node, wherein, when the driving high voltage is formed in the first node, the third transistor is turned on, and when the driving low voltage is supplied to the cathode of the LED in a state in which the third transistor is turned on, the LED emits light, and wherein a ramp voltage which increases or decreases with the lapse of time is supplied to a gate of the second transistor, and a start voltage of the ramp voltage is determined depending on a gray scale value of the pixel.

The pixel may further include: a connection control transistor having one side connected to the second transistor and the fourth transistor and the other side connected to the driving low voltage, and configured to control connection of the first path circuit and the second path circuit to the driving low voltage.

The pixel may further include: a fifth transistor configured to control connection of the gate and a drain of the second transistor, wherein, as the first transistor and the fifth transistor are turned on in a state in which the connection control transistor is turned off, a gate-source voltage of the second transistor becomes the same as a threshold voltage of the second transistor.

The pixel may further comprise: a sixth transistor configured to control connection of a gate and a drain of the fourth transistor, wherein, as the third transistor and the sixth transistor are turned on in a state in which the connection control transistor is turned off, a gate-source voltage of the fourth transistor becomes the same as a threshold voltage of the fourth transistor.

The pixel may further comprise: a first capacitor disposed between the gate of the second transistor and a data line, wherein, after the threshold voltage has been written into the gate-source of the second transistor and an initial voltage has been written into the first capacitor, a data voltage which increases or decreases with a predetermined slope is supplied through the data line.

The pixel may further include: a second capacitor having one side which is connected to the gate of the fourth transistor, wherein, after the threshold voltage has been written into the gate-source of the fourth transistor, a reference voltage is inputted to the other side of the second capacitor, and wherein the level of a current flowing through the LED is controlled by the reference voltage.

The pixel may further include: a connection control transistor having one side connected to the second transistor and the fourth transistor and the other side connected to the driving low voltage; a fifth transistor configured to control connection of the gate and a drain of the second transistor; a sixth transistor configured to control connection of a gate and a drain of the fourth transistor; a first capacitor disposed between the gate of the second transistor and a data line; a scan transistor configured to control connection of the first capacitor and the data line; and a second capacitor having one side connected to the gate of the fourth transistor and the other side through which a reference voltage is inputted.

A control time for the pixel may be divided into an initialization time, a program time and a light emission control time; and, during the initialization time, the first transistor, the second transistor and the sixth transistor may be turned on, and the scan transistor and the connection control transistor may be turned off.

During the program time subsequent to the initialization time, the fifth transistor, the sixth transistor, the scan transistor and the connection control transistor may be turned on, and the first transistor may be turned off.

The light emission control time subsequent to the program time may be divided into a plurality of sub-times; and during a first sub-time among the plurality of sub-times, the first transistor, the scan transistor, the connection control transistor and the fourth transistor may be turned on, and the fifth transistor and the sixth transistor may be turned off.

Each of the first transistor, the second transistor, the third transistor and the fourth transistor may be formed as a CMOS (complementary metal-oxide-semiconductor) type on a silicon backplane; the first transistor may be a P-type transistor; and each of the second transistor, the third transistor and the fourth transistor may be an N-type transistor.

Each of the first transistor, the second transistor, the third transistor and the fourth transistor may be formed as an NMOS (N-channel metal-oxide-semiconductor) type on an oxide backplane.

In still another aspect, the present disclosure provides a pixel driving device, with respect to which a pixel comprises a first path circuit comprising a first transistor and a second transistor disposed in series between a driving high voltage and a driving low voltage, a first node formed between the first transistor and the second transistor and a first capacitor is disposed between a gate of the second transistor and a data line, and a second path circuit comprising a third transistor and an LED disposed in series between the driving high voltage and the driving low voltage, a gate of the third transistor being electrically connected to the first node, to supply to the data line a data voltage, regarding which a ramp voltage, increasing or decreasing with the lapse of time, is formed in the gate of the second transistor and a start voltage of the ramp voltage is determined depending on a gray scale value of the pixel.

A control time for the pixel may be divided into an initialization time, a program time and a light emission control time; an initial voltage corresponding to a gray scale value of the pixel may be supplied as the data voltage during the program time; and the data voltage is changed to a predetermined voltage, and subsequently, the data voltage may be increased or decreased with a predetermined slope from the predetermined voltage during the light emission control time.

As is apparent from the above description, according to the embodiments, it is possible to easily implement a low gray scale in a display panel in which LEDs are disposed. Also, according to the embodiments, it is possible to drive a pixel in a PWM scheme without using a comparator. Further, according to the embodiments, it is possible to use a hybrid pixel driving technique in which a PAM scheme and a PWM scheme are combined.

DETAILED DESCRIPTION

Figure 1:
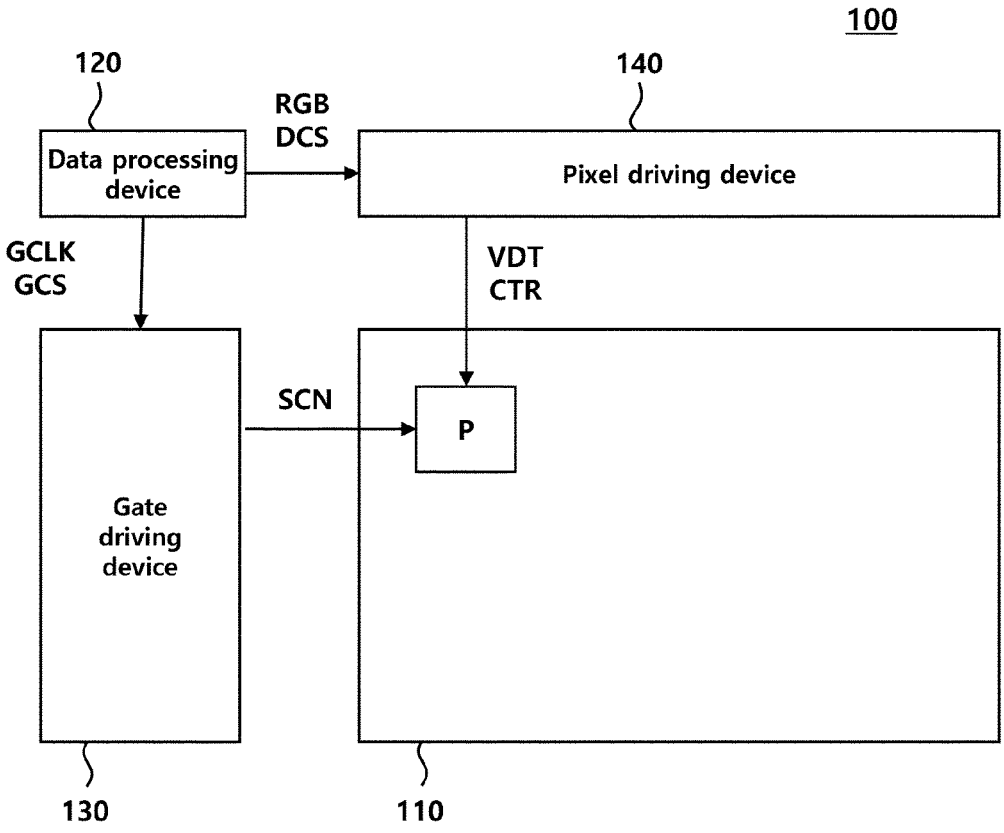
FIG. 1 is a configuration diagram of a display device in accordance with an embodiment.

FIG. 1 is a configuration diagram of a display device in accordance with an embodiment.

Referring to FIG. 1, a display device 100 may include a display panel 110, a data processing device 120, a gate driving device 130 and a pixel driving device 140.

A plurality of pixels P may be disposed in horizontal and vertical directions in the display panel 110.

An LED (light emitting diode) may be disposed in each pixel P. Each pixel P may express a gray scale value depending on a total amount of power or current supplied to the LED.

A plurality of transistors and at least one capacitor may be disposed in each pixel P. For example, eight transistors and two capacitors may be disposed in each pixel P. The total amount of power or current supplied to the LED may be determined by operations of these transistors and capacitors. Examples of the circuit structure of each pixel P will be described later.

The data processing device 120 may receive image data RGB from an external device such as a host, convert the image data RGB into data appropriate for the pixel driving device 140, and then transfer the converted data to the pixel driving device 140.

The data processing device 120 may control timing and provide setting values of the other components included in the display device 100. In this respect, the data processing device 120 is also referred to as a timing controller.

The data processing device 120 may transmit a gate clock GCLK and a gate control signal GCS to the gate driving device 130. The gate driving device 130 may generate a scan signal SCN according to the gate clock GCLK and supply the scan signal SCN to the pixel P.

A data voltage VDT may be supplied to the pixel P to which the scan signal SCN is supplied. The brightness of the pixel P may be controlled by the data voltage VDT.

The pixel driving device 140 may supply the data voltage VDT to the pixel P to which the scan signal SCN is supplied. The pixel driving device 140 may receive the image data RGB and a data control signal DCS from the data processing device 120, and may check a gray scale value of each pixel P according to the image data RGB. The pixel driving device 140 may generate the data voltage VDT depending on a gray scale value of each pixel P and supply the data voltage VDT to the corresponding pixel P.

The pixel driving device 140 may drive the pixel P in a hybrid scheme in which a PAM scheme and a PWM scheme are combined. Like the PAM scheme, the pixel driving device 140 may determine an initial voltage of the data voltage VDT depending on a gray scale value of each pixel P and supply the determined initial voltage to the pixel P. In addition, like the PWM scheme, the pixel P may express a gray scale value depending on an LED on-time during one control time, and the LED on-time may be determined by the initial voltage of the data voltage VDT.

For such a pixel driving scheme, at least one control signal CTR may be supplied to each pixel P. The control signal CTR may be supplied by the pixel driving device 140 or the gate driving device 130. Some of transistors which are disposed in each pixel P may be turned on or off by the control signal CTR.

The gate driving device 130 and the pixel driving device 140 may configure one integrated circuit. Alternatively, each of the gate driving device 130 and the pixel driving device 140 may configure a separate integrated circuit.

Figure 2:
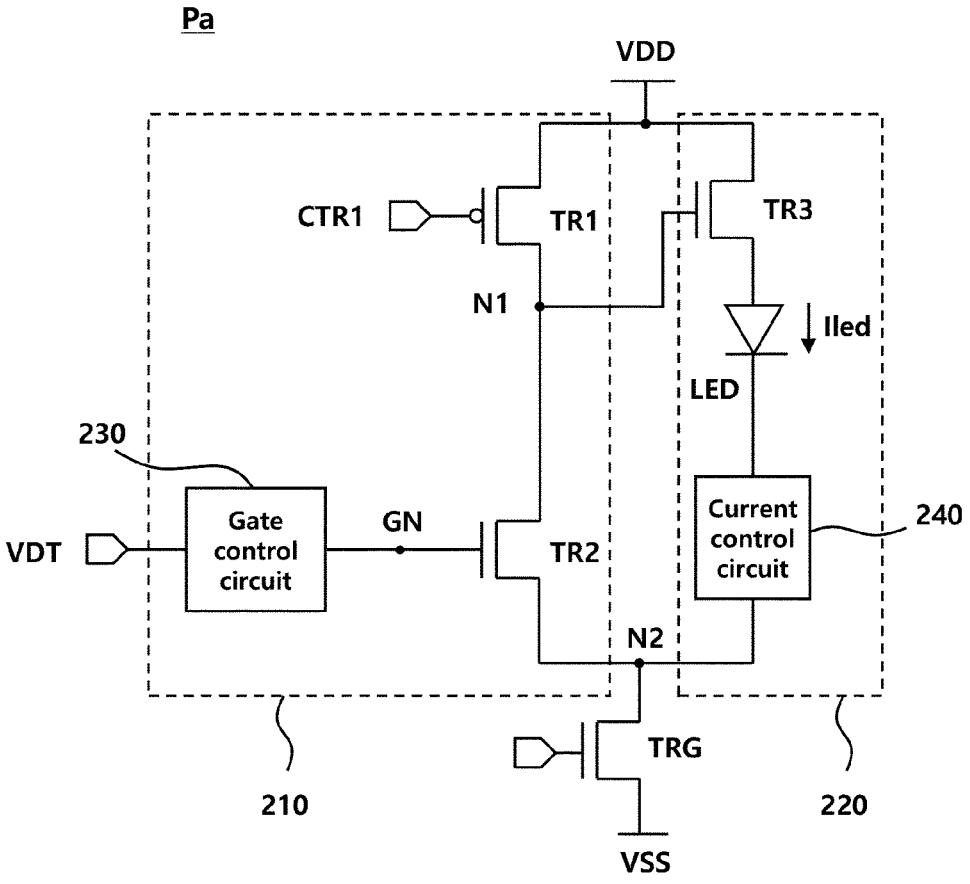
FIG. 2 is a configuration diagram illustrating a pixel in accordance with a first embodiment.

FIG. 2 is a configuration diagram illustrating a pixel in accordance with a first embodiment.

Referring to FIG. 2, a pixel Pa may include a first path circuit 210, a second path circuit 220 and a connection control transistor TRG.

The first path circuit 210 may include a first transistor TR1 and a second transistor TR2 which are disposed in series between a driving high voltage VDD and a driving low voltage VSS. The first path circuit 210 may further include a gate control circuit 230 which controls the gate of the second transistor TR2.

The first transistor TR1 as a P-type transistor may have one side which is connected to the driving high voltage VDD and the other side which is connected to a first node N1. A first control signal CTR1 may be supplied to the gate of the first transistor TR1. The first control signal CTR1 may be supplied by a pixel driving device or a gate driving device.

The first transistor TR1 may control the supply of the driving high voltage VDD to the first node N1. When the first transistor TR1 is turned on, the driving high voltage VDD may be supplied to the first node N1.

The second transistor TR2 may have one side which is connected to the first node N1 and the other side which is connected to a second node N2. The connection control transistor TRG may have one side which is connected to the second node N2 and the other side which is connected to the driving low voltage VSS.

Substantially, the second transistor TR2 may control the supply of the driving low voltage VSS to the first node N1. When the connection control transistor TRG is turned on, the driving low voltage VSS may be supplied to the second node N2, and when the second transistor TR2 is turned on in this state, the driving low voltage VSS may be supplied to the first node N1.

In the state in which the connection control transistor TRG is turned on, when the first transistor TR1 is turned on, the driving high voltage VDD may be formed in the first node N1, and when the second transistor TR2 is turned on, the driving low voltage VSS may be formed in the first node N1.

The second path circuit 220 may include a third transistor TR3 and an LED LED which are disposed in series between the driving high voltage VDD and the driving low voltage VSS.

The second path circuit 220 may further include a current control circuit 240 which controls the magnitude of a driving current Iled flowing through the LED LED.

The third transistor TR3 may have one side which is connected to the driving high voltage VDD and the other side which is connected to the anode of the LED LED. The gate of the third transistor TR3 may be connected to the first node N1.

The anode of the LED LED may be connected to the other side of the third transistor TR3, and the cathode of the LED LED may be connected to the second node N2. According to an embodiment, the current control circuit 240 may be additionally disposed between the cathode of the LED LED and the second node N2.

The pixel Pa may be formed on a silicon backplane, and the transistors TR1, TR2, TR3 and TRG disposed in the pixel Pa may be formed as a CMOS (complementary metal-oxide-semiconductor) type.

Describing the operations of the respective components, when a high voltage (for example, the driving high voltage VDD) is formed in the first node N1, the third transistor TR3 may be turned on, and thus, the driving current Iled may flow through the LED LED. When a low voltage (for example, the driving low voltage VSS) is formed in the first node N1, the third transistor TR3 may be turned off, and thus, the LED LED may be turned off.

A voltage of the first node N1 may be determined depending on the turn-on and turn-off of the first transistor TR1 and the second transistor TR2.

A gate voltage of the first transistor TR1 may be determined by the first control signal CTR1, and the turn-on and turn-off of the first transistor TR1 may be determined depending on the first control signal CTR1.

A gate voltage of the second transistor TR2 may be determined by a voltage of a gate node GN, and a ramp voltage which increases or decreases with the lapse of time may be supplied to the gate node GN. A start voltage of the ramp voltage may be determined depending on a gray scale value of the pixel Pa.

The gate node GN may be connected to a data line. The voltage of the gate node GN may be determined depending on a data voltage VDT which is supplied through the data line. The gate control circuit 230 may be disposed between the gate node GN and the data line.

Figure 3:
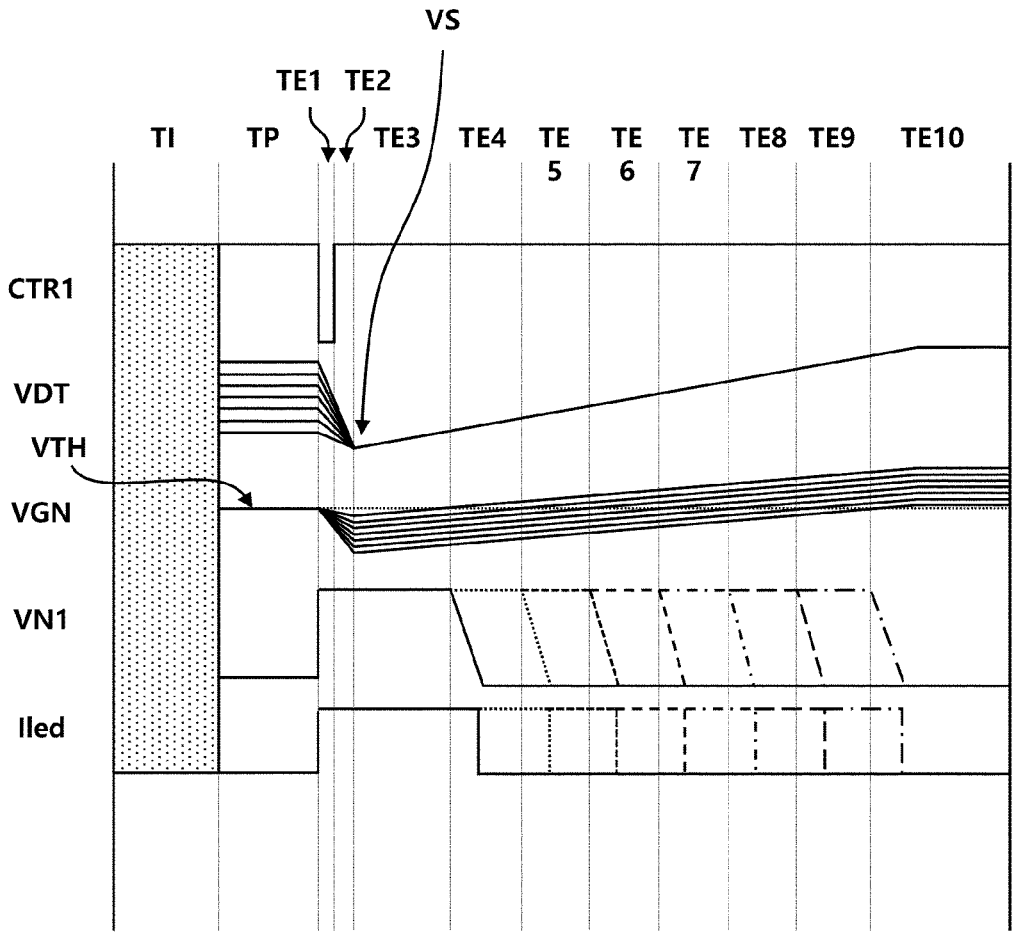
FIG. 3 is a waveform diagram of main signals, voltages and currents of the circuit of the pixel in accordance with the first embodiment.

FIG. 3 is a waveform diagram of main signals, voltages and currents of the circuit of the pixel in accordance with the first embodiment.

Referring to FIGS. 2 and 3, a control time of the pixel Pa may be divided into an initialization time TI, a program time TP and a light emission control time TE1 to TE10. The control time of the pixel Pa may be the same as a time of one frame, or may be the same as a 1 H (horizontal) time.

The initialization time TI may be a time required for initializing voltages of respective nodes and terminals of respective transistors, and various schemes may be applied thereto. These schemes will be described in more detail in examples to be described later.

The program time TP is a time required for writing specific voltages to main nodes and main transistors.

During the program time TP of the first embodiment, the first control signal CTR1 may form a high voltage, thereby turning off the first transistor TR1. Further, although not shown, the connection control transistor TRG may be turned on and thereby form the driving low voltage VSS in the second node N2. The driving low voltage VSS may be a ground voltage.

As the second transistor TR2 is turned on during the program time TP, a voltage VN1 of the first node N1 may become a low voltage. At this time, a gate voltage VGN of the second transistor TR2 may be the same as a threshold voltage VTH of the second transistor TR2. In other words, during the program time TP, although the second transistor TR2 is turned on, no substantial current may flow through the drain and the source of the second transistor TR2.

During the program time TP, as the voltage VN1 of the first node N1 becomes a low voltage, the third transistor TR3 is turned off, and the driving current Iled of the LED LED becomes 0 A.

During the program time TP, the data voltage VDT may be an initial voltage. The pixel driving device may determine the initial voltage depending on a gray scale value of the pixel Pa, may set the data voltage VDT as the initial voltage, and may supply the data voltage VDT to the data line.

The initial voltage supplied to the data line may be written into the gate control circuit 230. The initial voltage may be written into one side of the gate control circuit 230, and the gate voltage VGN may be written into the other side of the gate control circuit 230. The gate control circuit 230 may maintain such a voltage across the gate control circuit 230 (the initial voltage−the gate voltage VGN) during a subsequent control time.

The light emission control time TE1 to TE10 may be divided into a plurality of sub-times TE1 to TE10.

During a first sub-time TE1 and a second sub-time TE2 among the plurality of sub-times TE1 to TE10, the pixel driving device may change the data voltage VDT to a preset predetermined voltage VS.

Since the gate control circuit 230 disposed between the data line and the gate node GN maintains the voltage across the gate control circuit 230 (the initial voltage−the gate voltage VGN), a change in the data voltage VDT may cause a change in the gate voltage VGN. By such a change, the gate voltage VGN may become lower than the threshold voltage VTH, and the second transistor TR2 may be turned off.

During the first sub-time TE1, the first transistor TR1 may be turned on according to the first control signal CTR1, and the voltage VN1 of the first node N1 may become the driving high voltage VDD. The third transistor TR3 may be turned on according to the voltage VN1 of the first node N1, and the driving current Iled may flow through the LED LED, by which the LED LED may emit light.

The light emission of the LED LED may continue while the gate voltage VGN maintains a voltage lower than the threshold voltage VTH.

From a third sub-time TE3, the pixel driving device may increase or decrease the data voltage VDT with a predetermined slope from the predetermined voltage VS. As the gate voltage VGN changes according to such an increase or decrease in the data voltage VDT and becomes larger the threshold voltage VTH, the LED LED may be turned off.

From the third sub-time TE3, the gate voltage VGN may have the form of a ramp voltage which increases or decreases with a predetermined slope, and a start voltage of the ramp voltage may be determined depending on the initial voltage supplied to the data line during the program time TP. Since the gate control circuit 230 maintains the voltage across the gate control circuit 230 (the initial voltage−the gate voltage VGN), the gate voltage VGN may change by a level by which the data voltage VDT is changed from the initial voltage to the predetermined voltage VS, and the changed gate voltage VGN may be the start voltage of the ramp voltage.

The turn-on and turn-off of the pixel Pa may be determined in a PWM scheme according to the comparison between the gate voltage VGN and the threshold voltage VTH. A variable that determines a turn-on time of PWM is the initial voltage of the data voltage VDT. In this respect, the embodiment may be regarded as a hybrid scheme in which a PAM scheme and the PWM scheme are combined.

Figure 4:
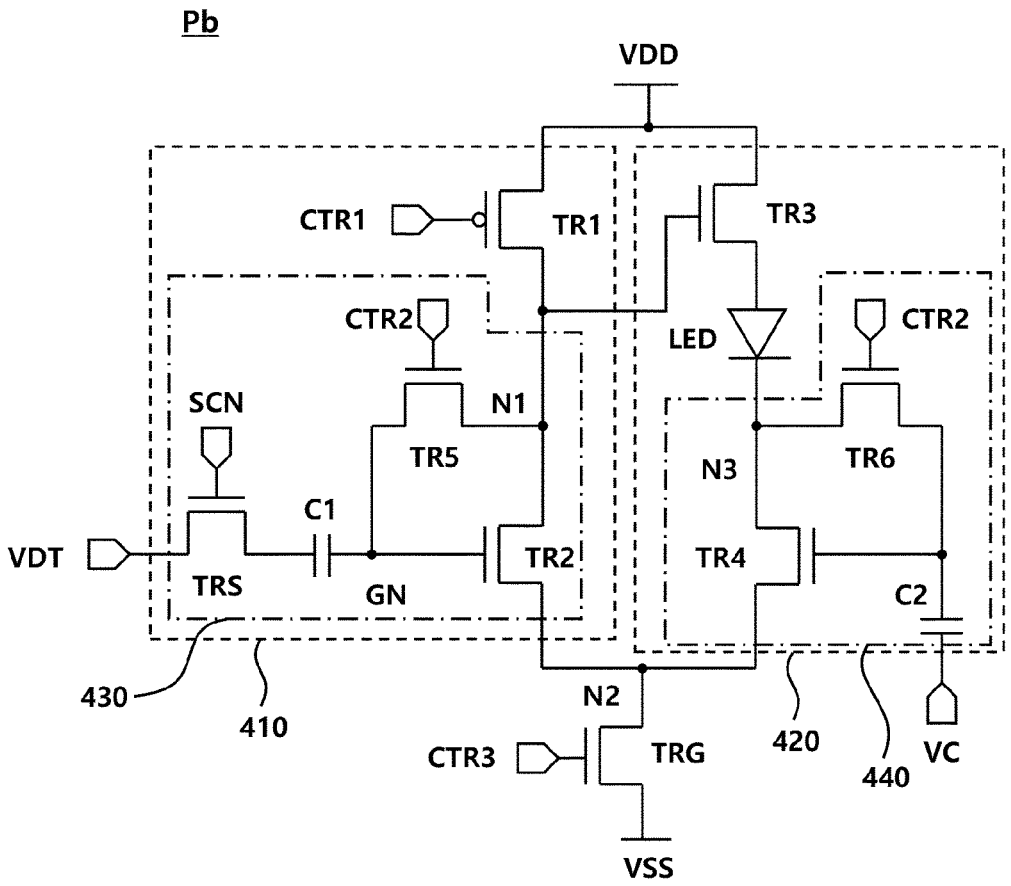
FIG. 4 is a configuration diagram illustrating a pixel in accordance with a second embodiment.

FIG. 4 is a configuration diagram illustrating a pixel in accordance with a second embodiment.

Referring to FIG. 4, a pixel Pb may include a first path circuit 410, a second path circuit 420 and a connection control transistor TRG.

The first path circuit 410 may include a first transistor TR1 which controls the supply of a driving high voltage VDD to a first node N1 and a second transistor TR2 which controls the supply of a driving low voltage VSS to the first node N1.

The second path circuit 420 may include a third transistor TR3 which controls the supply of the driving high voltage VDD to the anode of an LED LED and a fourth transistor TR4 which controls the supply of the driving low voltage VSS to the cathode of the LED LED.

The gate of the third transistor TR3 may be connected to the first node N1. When the driving high voltage VDD is formed in the first node N1, the third transistor TR3 may be turned on. When the driving low voltage VSS is supplied to the cathode of the LED LED in the state in which the third transistor TR3 is turned on, the LED LED may emit light.

During a period in which the LED LED emits light, a ramp voltage which increases or decreases with the lapse of time may be supplied to the gate of the second transistor TR2. A start voltage of the ramp voltage may be determined depending on a gray scale value of the pixel Pb.

One side of the connection control transistor TRG may be connected to a second node N2 as a contact point with the second transistor TR2 and the fourth transistor TR4, and the other side of the connection control transistor TRG may be connected to the driving low voltage VSS.

The first path circuit 410 may further include a gate control circuit 430, and the second path circuit 420 may further include a current control circuit 440.

The gate control circuit 430 may include a fifth transistor TR5 which controls the connection between the gate and the drain of the second transistor TR2. In a state in which the connection control transistor TRG is turned off, as the first transistor TR1 and the fifth transistor TR5 are turned on, a gate-source voltage of the second transistor TR2 may become the same as a threshold voltage of the second transistor TR2.

The gate control circuit 430 may further include a first capacitor C1 which is disposed between the gate of the second transistor TR2 and a data line. The threshold voltage may be written into the gate-source of the second transistor TR2, and an initial voltage may be written into the other side (a side connected to the data line) of the first capacitor C1. The first capacitor C1 may maintain a voltage across the first capacitor C1, which is formed as described above.

The current control circuit 440 may include a sixth transistor TR6 which controls the connection between the gate and the drain of the fourth transistor TR4. In a state in which the connection control transistor TRG is turned off, as the third transistor TR3 and the sixth transistor TR6 are turned on, a gate-source voltage of the fourth transistor TR4 may become the same as a threshold voltage of the fourth transistor TR4.

The current control circuit 440 may further include a second capacitor C2 whose one side is connected to the gate of the fourth transistor TR4. After the threshold voltage is written into the gate-source of the fourth transistor TR4, a reference voltage VC may be inputted to the other side of the second capacitor C2. The magnitude of a driving current of the LED LED may be controlled depending on a voltage level of the reference voltage VC.

Describing connection relationships, in the first path circuit 410, the first transistor TR1 may have one side which is connected to the driving high voltage VDD and the other side which is connected to the first node N1. The second transistor TR2 may have one side which is connected to the first node N1 and the other side which is connected to the second node N2. The fifth transistor TR5 may have one side which is connected to the drain of the second transistor TR2 and the other side which is connected to the gate of the second transistor TR2. The first capacitor C1 may have one side which is connected to the gate of the second transistor TR2 and the other side which is connected to one side of a scan transistor TRS. The other side of the scan transistor TRS may be connected to the data line.

In the second path circuit 420, the third transistor TR3 may have one side which is connected to the driving high voltage VDD and the other side which is connected to the anode of the LED LED. The fourth transistor TR4 may have one side which is connected to the cathode of the LED LED and the other side which is connected to the second node N2. The sixth transistor TR6 may have one side which is connected to the drain of the fourth transistor TR4 and the other side which is connected to the gate of the fourth transistor TR4. The second capacitor C2 may have one side which is connected to the gate of the fourth transistor TR4 and the other side to which the reference voltage VC is supplied.

A first control signal CTR1 may be supplied to the gate of the first transistor TR1, a second control signal CTR2 may be supplied to the fifth transistor TR5 and the sixth transistor TR6, and a third control signal CTR3 may be supplied to the connection control transistor TRG. A scan signal SCN may be supplied to the scan transistor TRS.

Figure 5:
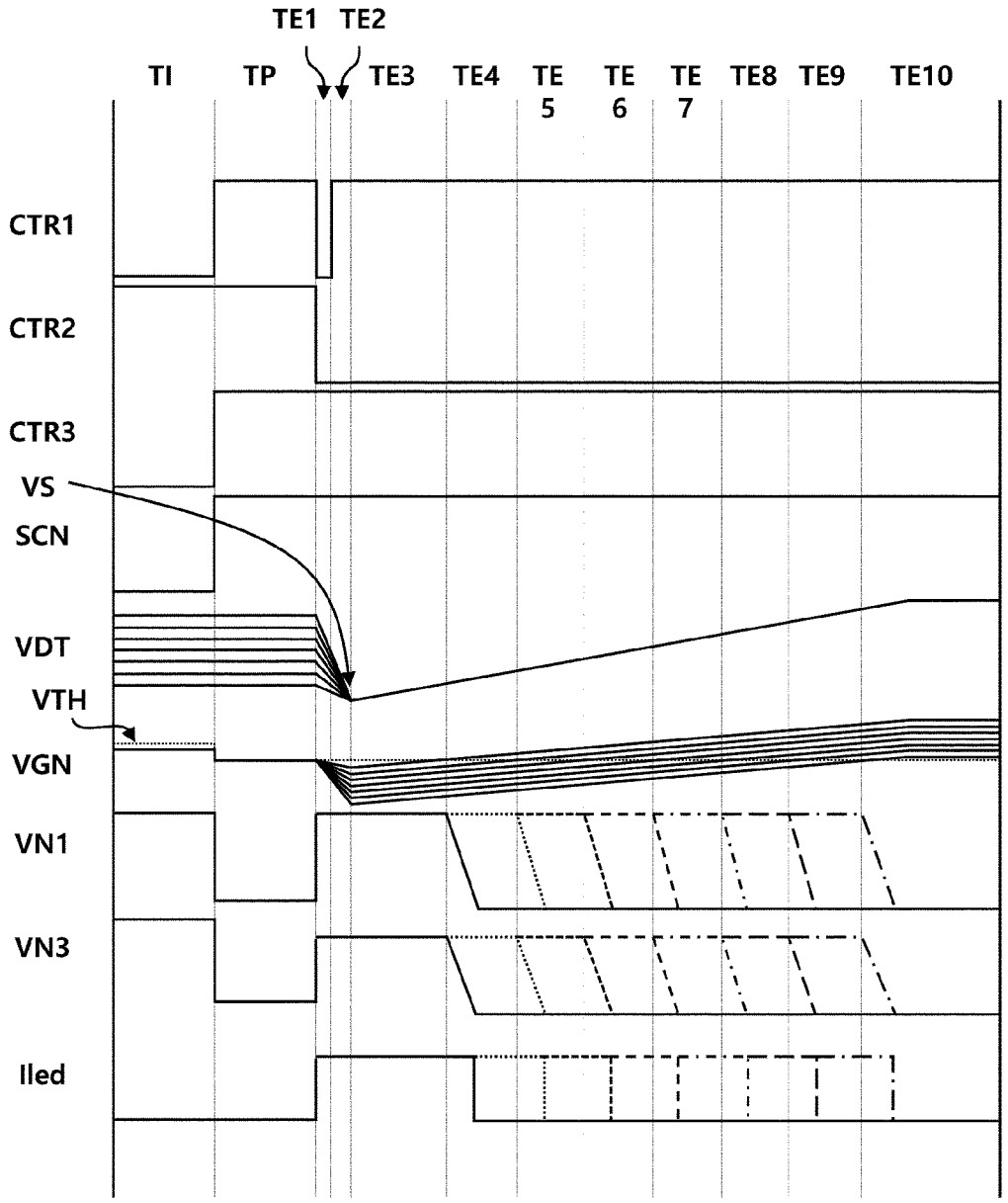
FIG. 5 is a waveform diagram of main signals, voltages and currents of the circuit of the pixel in accordance with the second embodiment.
Figure 6:
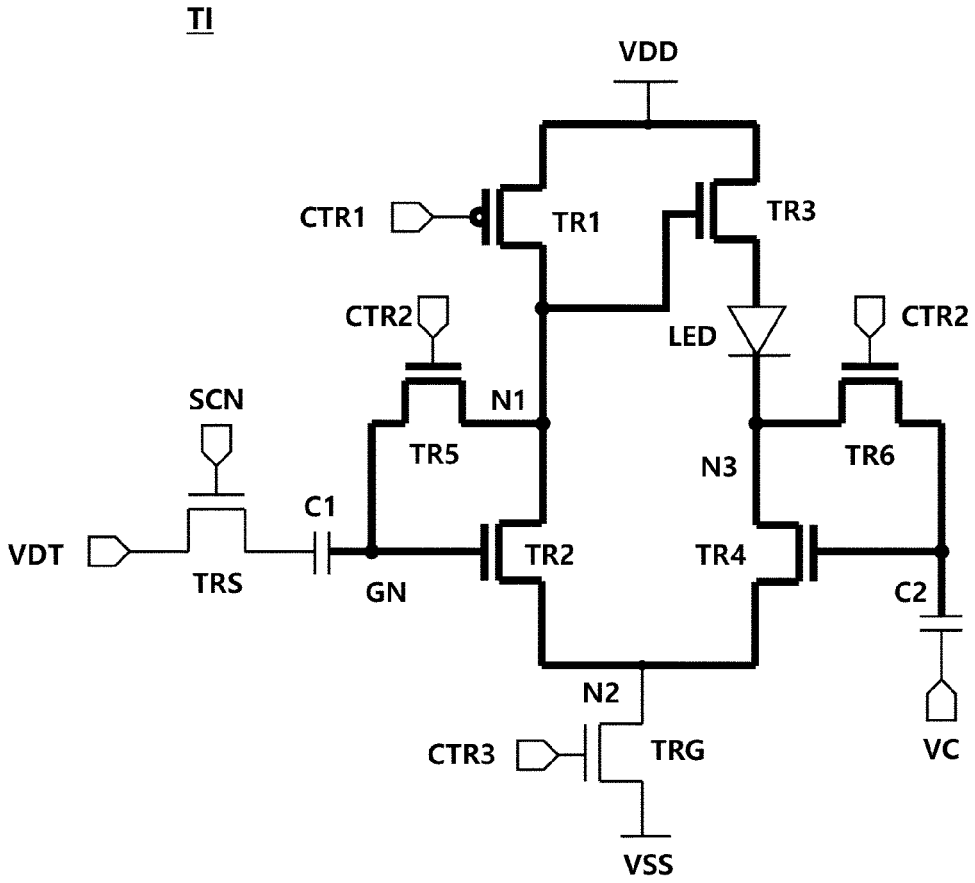
FIG. 6 is a diagram illustrating components which are turned on during an initialization time in the pixel in accordance with the second embodiment.
Figure 7:
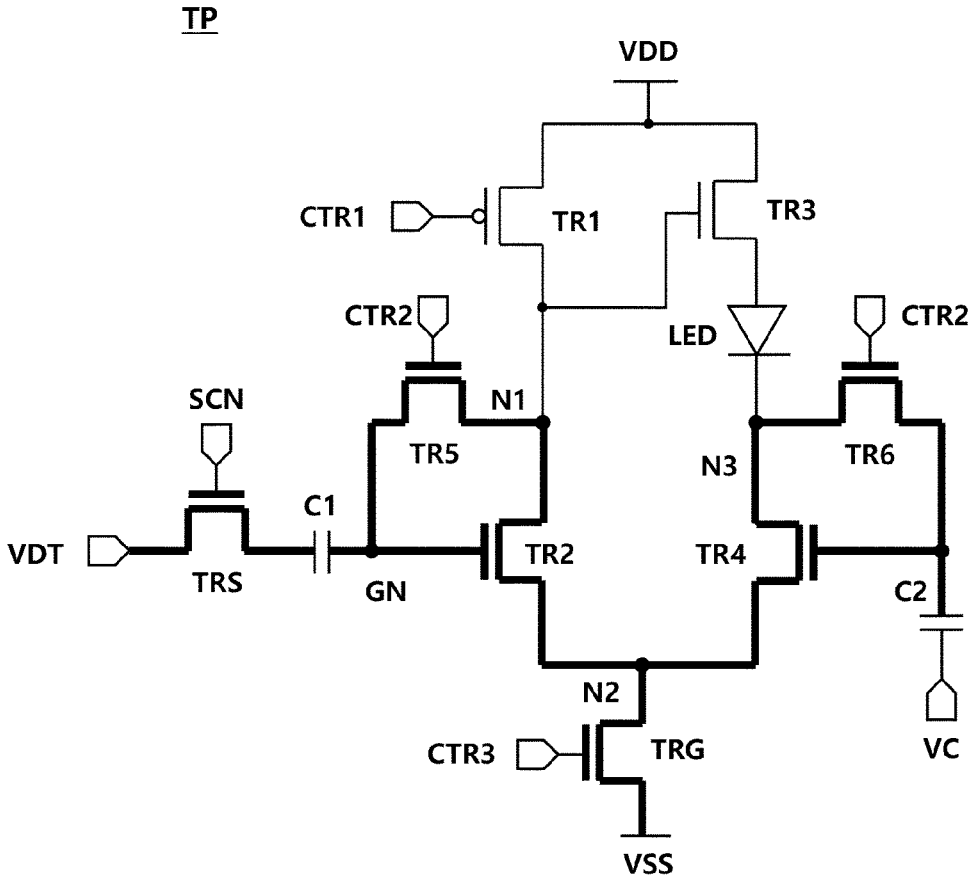
FIG. 7 is a diagram illustrating components which are turned on during a program time in the pixel in accordance with the second embodiment.
Figure 8:
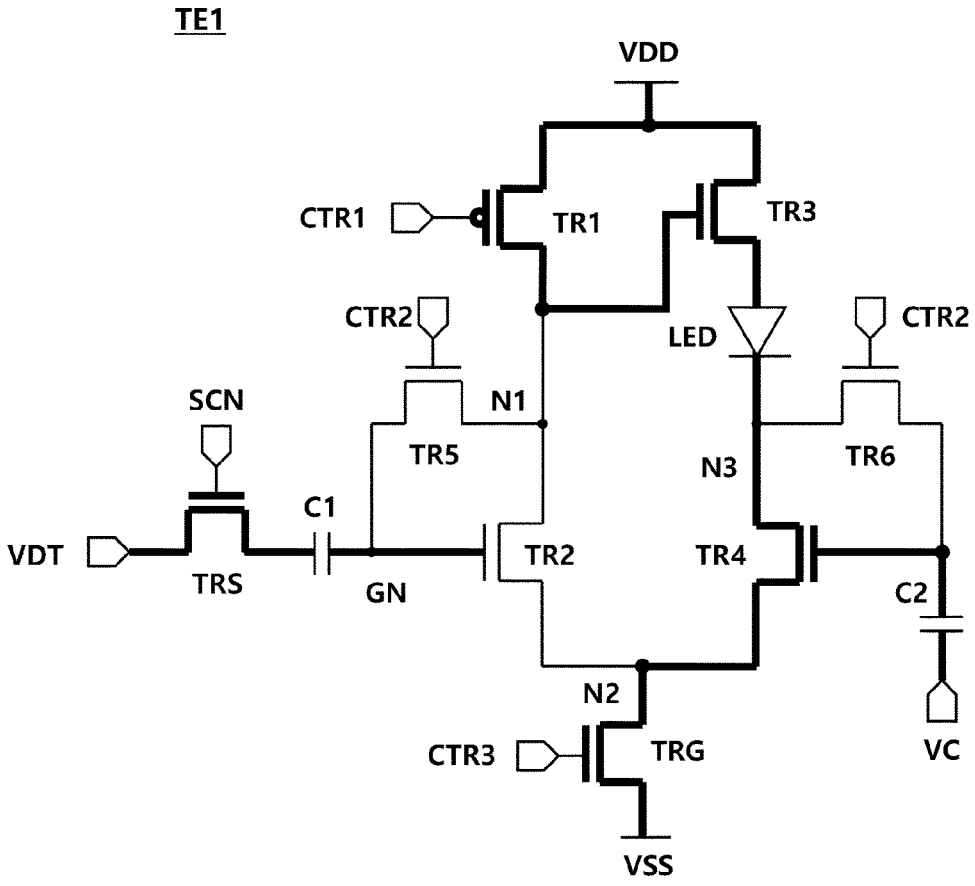
FIG. 8 is a diagram illustrating components which are turned on during a first sub-time of a light emission control time in the pixel in accordance with the second embodiment.
Figure 9:
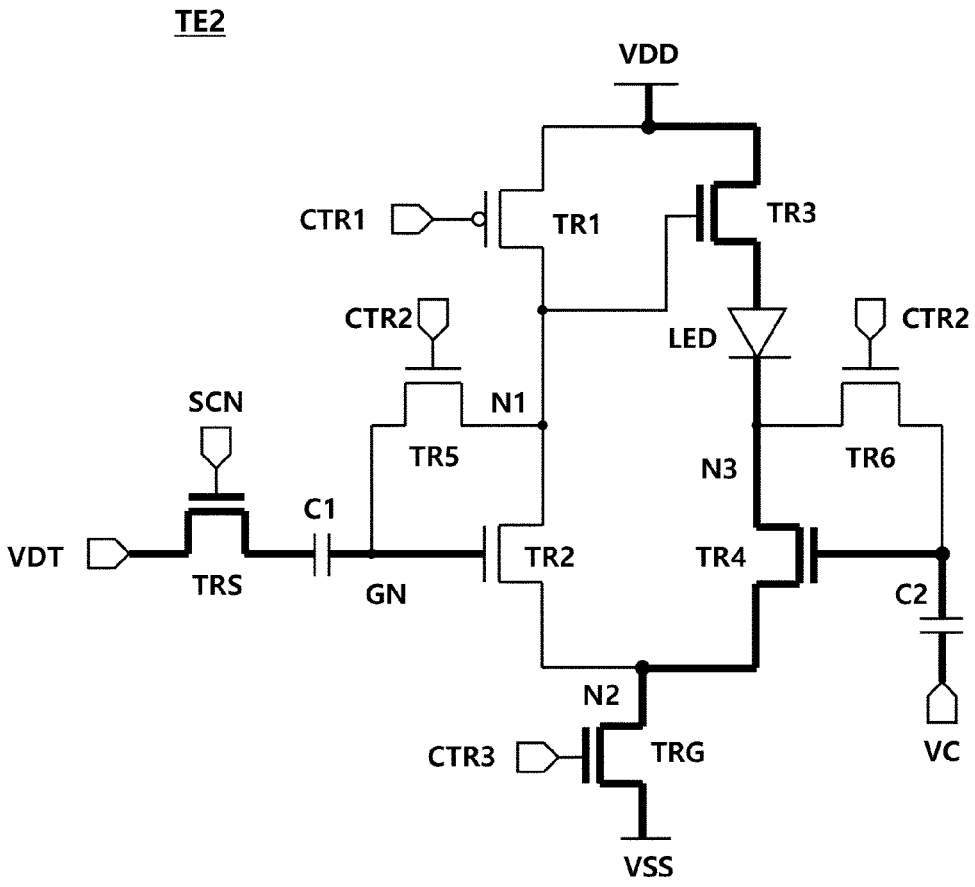
FIG. 9 is a diagram illustrating components which are turned on during a second sub-time of the light emission control time in the pixel in accordance with the second embodiment.
Figure 10:
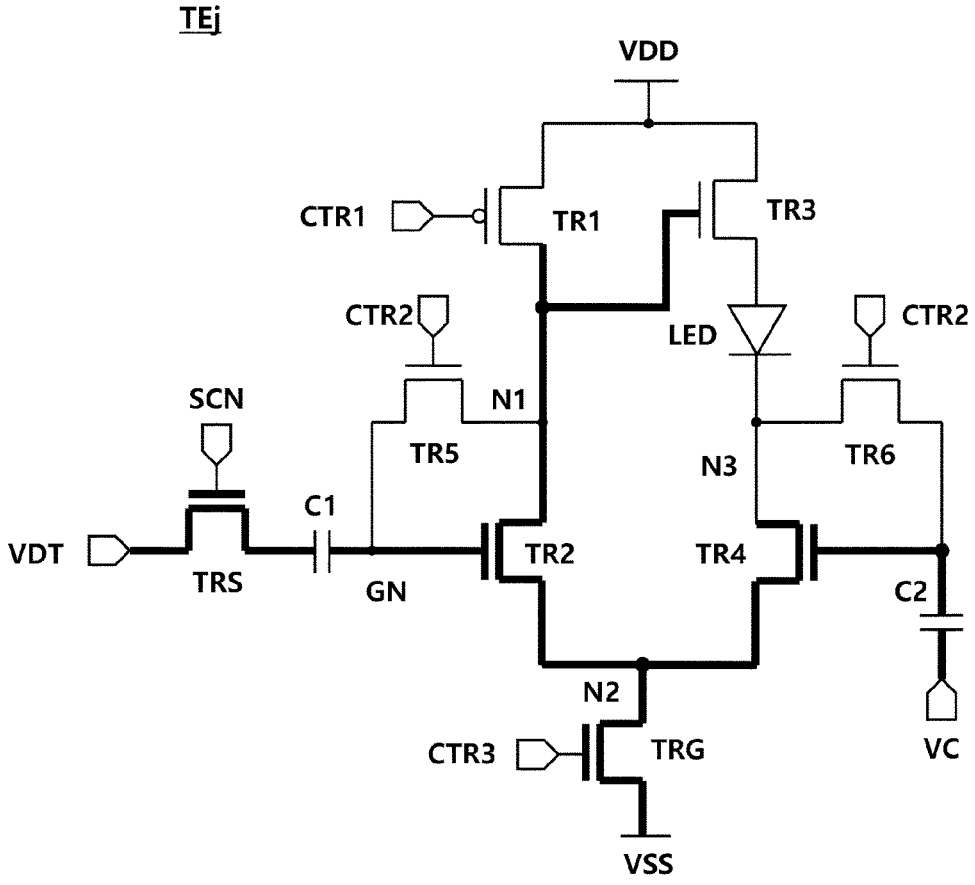
FIG. 10 is a diagram illustrating components which are turned on during a sub-time of the light emission control time, in which an LED is turned off, in the pixel in accordance with the second embodiment.

FIG. 5 is a waveform diagram of main signals, voltages and currents of the circuit of the pixel in accordance with the second embodiment. FIG. 6 is a diagram illustrating components which are turned on during an initialization time in the pixel in accordance with the second embodiment, FIG. 7 is a diagram illustrating components which are turned on during a program time in the pixel in accordance with the second embodiment, FIG. 8 is a diagram illustrating components which are turned on during a first sub-time of a light emission control time in the pixel in accordance with the second embodiment, FIG. 9 is a diagram illustrating components which are turned on during a second sub-time of the light emission control time in the pixel in accordance with the second embodiment, and FIG. 10 is a diagram illustrating components which are turned on during a sub-time of the light emission control time, in which an LED is turned off, in the pixel in accordance with the second embodiment.

Referring to FIGS. 4 to 10, a control time of the pixel Pb may be divided into an initialization time TI, a program time TP and a light emission control time TE1 to TE10.

During the initialization time TI, the first transistor TR1, the second transistor TR2, the third transistor TR3, the fourth transistor TR4, the fifth transistor TR5 and the sixth transistor TR6 may be turned on, and the connection control transistor TRG and the scan transistor TRS may be turned off. Accordingly, the first node N1, a gate node GN, the second node N2 and the third node N3 may be initialized to the driving high voltage VDD.

During the program time TP, the first transistor TR1 and the third transistor TR3 may be turned off, and the second transistor TR2, the fourth transistor TR4, the fifth transistor TR5, the sixth transistor TR6, the connection control transistor TRG and the scan transistor TRS may be turned on. Accordingly, a voltage VGN of the gate node GN of the second transistor TR2 may be programmed to be the same as a threshold voltage VTH of the second transistor TR2, and a gate voltage of the fourth transistor TR4 may be programmed to be the same as a threshold voltage of the fourth transistor TR4.

During the program time TP, an initial voltage corresponding to a gray scale value of the pixel Pb may be supplied as a data voltage VDT. Accordingly, the initial voltage may be formed on the other side of the first capacitor C1, and the threshold voltage VTH of the second transistor TR2 may be formed on the one side of the first capacitor C1.

A voltage across the first capacitor C1 (the initial voltage–the threshold voltage VTH of the second transistor TR2) may be maintained even during the light emission control time TE1 to TE10.

The light emission control time TE1 to TE10 may be divided into a plurality of sub-times TE1 to TE10.

During a first sub-time TE1, the first transistor TR1, the fourth transistor TR4, the connection control transistor TRG and the scan transistor TRS may be turned on. As the first transistor TR1 is turned on, the driving high voltage VDD may be formed in the first node N1, and accordingly, the third transistor TR3 may be turned on.

As the reference voltage VC is supplied to the other side of the second capacitor C2, the gate voltage of the fourth transistor TR4 may be maintained at an appropriate level, and a driving current of the LED LED may be controlled at a constant level.

During the first sub-time TE1 and a second sub-time TE2, the data voltage VDT may be changed to a preset predetermined voltage VS. According to this change, the gate voltage VGN may be changed to the start voltage. The start voltage may be the same as a voltage obtained by subtracting a voltage across the first capacitor C1 from the predetermined voltage VS, and may be expressed in an equation as follows.

Start voltage=predetermined voltage−(initial voltage−threshold voltage)

During the first sub-time TE1, as the gate voltage VGN becomes lower than the threshold voltage VTH of the second transistor TR2, the second transistor TR2 may be turned off, and the LED LED may be turned on.

During the second sub-time TE2, as the first transistor TR1 is turned off and the remaining transistors maintain their states, the light emission of the LED LED may be maintained.

From a third sub-time TE3, the data voltage VDT may increase with a predetermined slope from the predetermined voltage VS. Accordingly, as the gate voltage VGN increases and becomes larger than the threshold voltage VTH at a j-th (j is a natural number equal to or greater than 3) sub-time TEj, the second transistor TR2 may be turned on, and the voltage VN1 of the first node N1 may decrease to the driving low voltage VSS. According to the voltage VN1 of the first node N1, the third transistor TR3 may be turned off, and the LED LED may be turned off.

In order to facilitate understanding, the third node N3 and a voltage VN3 of the third node N3 are shown in FIGS. 4 to 10.

The pixel Pb may be formed on a silicon backplane, and the transistors disposed in the pixel Pb may be formed as a CMOS (complementary metal-oxide-semiconductor) type.

The pixel Pb may be formed on an oxide backplane.

Figure 11:
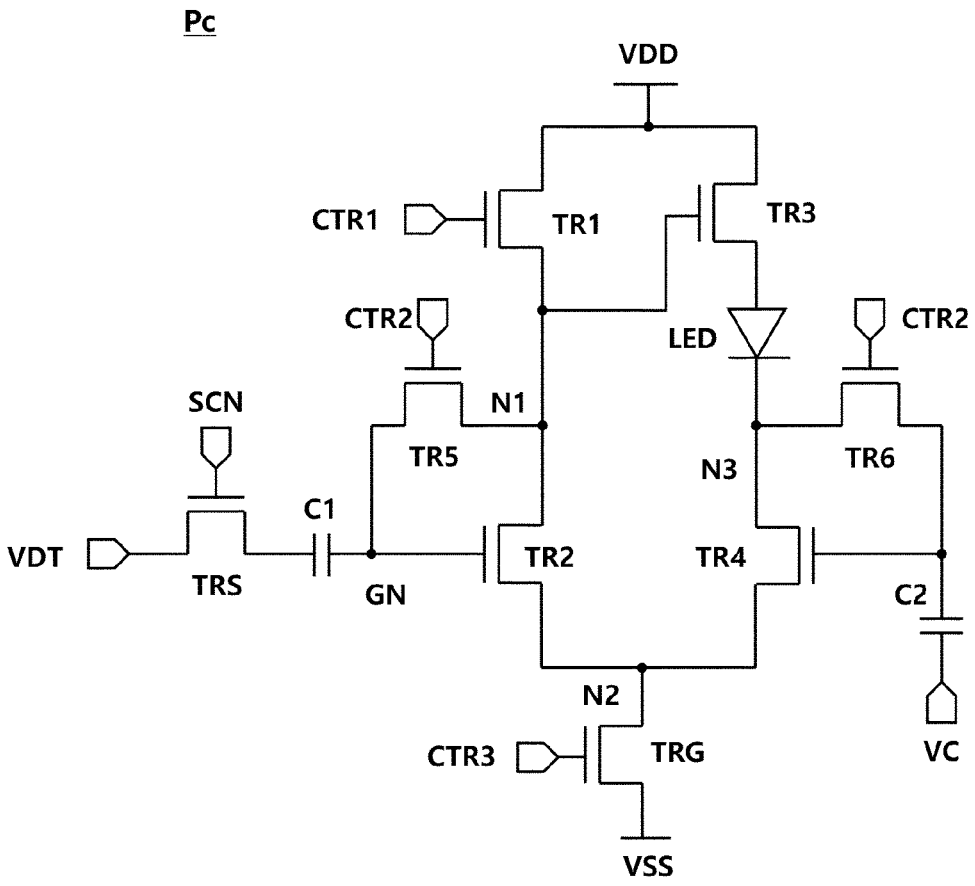
FIG. 11 is a configuration diagram illustrating a pixel in accordance with a third embodiment.

FIG. 11 is a configuration diagram illustrating a pixel in accordance with a third embodiment.

In FIG. 11, a pixel Pc may be formed on an oxide backplane. Transistors disposed in the pixel Pc may be formed as an NMOS (N-channel metal-oxide-semiconductor) type.

Compared to the pixel Pb in accordance with the second embodiment illustrated in FIG. 4, in the third embodiment, only a first transistor TR1 may be changed to an N type, and remaining transistors may be formed in the N type as they are.

In operation, only a first control signal CTR1 supplied to the first transistor TR1 may have an inverted waveform of the waveform in the second embodiment, and the other signals may have the same waveforms.

The pixel Pc may be formed on a low temperature polysilicon (LTPS) backplane.

Figure 12:
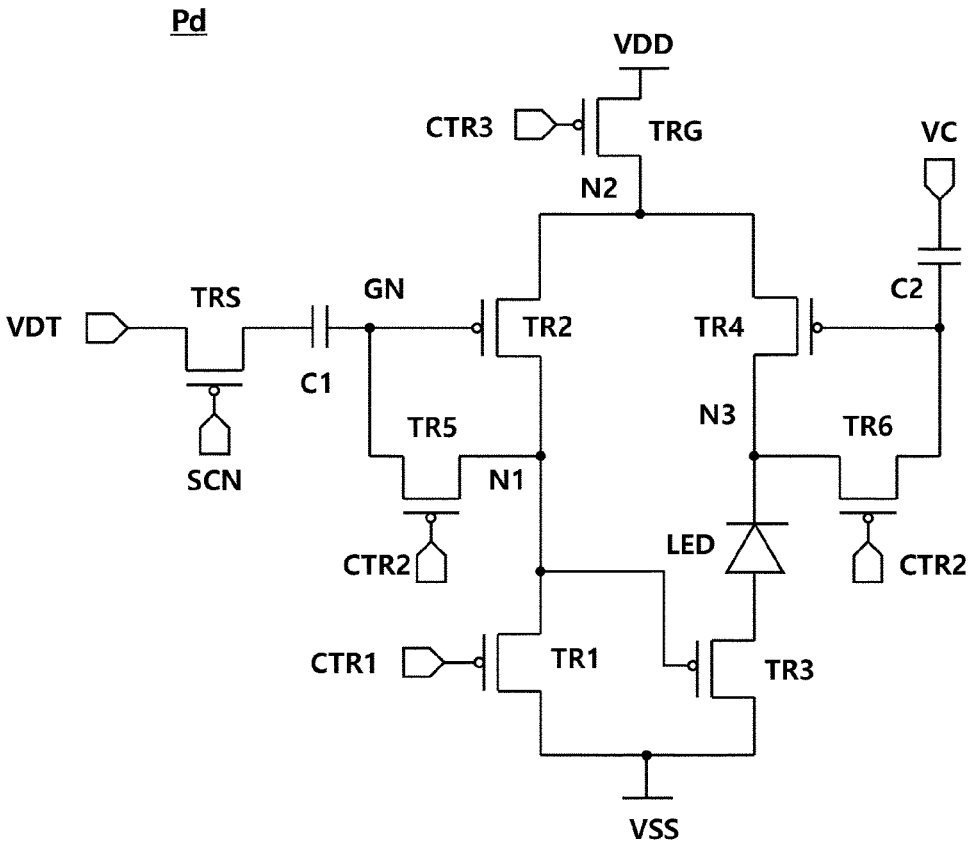
FIG. 12 is a configuration diagram illustrating a pixel in accordance with a fourth embodiment.

FIG. 12 is a configuration diagram illustrating a pixel in accordance with a fourth embodiment.

Referring to FIG. 12, a pixel Pd may be formed on a low temperature polysilicon backplane.

Compared to the pixel Pc in accordance with the third embodiment illustrated in FIG. 11, in the fourth embodiment, all transistors may be formed in a P type. Further, compared to the third embodiment, in the fourth embodiment, supply positions of the driving high voltage VDD and the driving low voltage VSS may be reversed.

In operation, all control signals may have inverted waveforms of the waveforms in the third embodiment. A data voltage VDT and a reference voltage VC may also have opposite voltage levels.

As is apparent from the above description, according to the embodiments, it is possible to easily implement a low gray scale in a display panel in which LEDs are disposed. Also, according to the embodiments, it is possible to drive a pixel in a PWM scheme without using a comparator. Further, according to the embodiments, it is possible to use a hybrid pixel driving technique in which a PAM scheme and a PWM scheme are combined.

What is claimed is:

1. A light emitting diode (LED) driving circuit, which drives an LED disposed in a pixel, comprising:

a first path circuit comprising a first transistor and a second transistor which are disposed in series between a driving high voltage and a driving low voltage and a first node formed between the first transistor and the second transistor; and a second path circuit comprising a third transistor which is disposed in series with the LED between the driving high voltage and the driving low voltage, a gate of the third transistor being electrically connected to the first node, wherein a ramp voltage, which increases or decreases with a lapse of time, is supplied to a gate of the second transistor and a start voltage of the ramp voltage is determined depending on a gray scale value of the pixel.

2. The LED driving circuit of claim 1, wherein the LED is turned off at a time point when a gate-source voltage of the second transistor becomes the same as a threshold voltage of the second transistor after increasing or decreasing depending on the ramp voltage.

3. The LED driving circuit of claim 1, wherein a control time for the pixel is divided into an initialization time, a program time, and a light emission control time, wherein an initial voltage according to a gray scale value of the pixel is written into the pixel during the program time and the start voltage is set depending on the initial voltage at an initial stage of the light emission control time.

4. The LED driving circuit of claim 3, wherein a capacitor is disposed between the gate of the second transistor and a data line and the initial voltage is written into the capacitor during the program time.

5. The LED driving circuit of claim 4, wherein a data voltage supplied to the data line is changed to a predetermined voltage at the initial stage of the light emission control time, and thereafter, the level of the data voltage increases or decreases with a predetermined slope.

6. A display panel, in which a plurality of pixels are disposed, each pixel comprising:

a first path circuit comprising a first transistor which controls a supply of a driving high voltage to a first node and a second transistor which controls a supply of a driving low voltage to the first node; and a second path circuit comprising a third transistor which controls a supply of the driving high voltage to an anode of an LED and a fourth transistor which controls a supply of the driving low voltage to a cathode of the LED, a gate of the third transistor being connected to the first node, wherein, when the driving high voltage is formed in the first node, the third transistor is turned on and, when the driving low voltage is supplied to the cathode of the LED in a state in which the third transistor is turned on, the LED emits light, and wherein a ramp voltage which increases or decreases with a lapse of time is supplied to a gate of the second transistor and a start voltage of the ramp voltage is determined depending on a gray scale value of the pixel.

7. The display panel of claim 6, wherein the pixel further comprises a connection control transistor having one side connected to the second transistor and the fourth transistor and an other side connected to the driving low voltage and configured to control connection of the first path circuit and the second path circuit to the driving low voltage.

8. The display panel of claim 7, wherein the pixel further comprises a fifth transistor configured to control connection of the gate and a drain of the second transistor, wherein, as the first transistor and the fifth transistor are turned on in a state in which the connection control transistor is turned off, a gate-source voltage of the second transistor becomes the same as a threshold voltage of the second transistor.

9. The display panel of claim 7, wherein the pixel further comprises a sixth transistor configured to control connection of a gate and a drain of the fourth transistor, wherein, as the third transistor and the sixth transistor are turned on in a state in which the connection control transistor is turned off, a gate-source voltage of the fourth transistor becomes the same as a threshold voltage of the fourth transistor.

10. The display panel of claim 6, wherein the pixel further comprises a first capacitor disposed between the gate of the second transistor and a data line, wherein, after the threshold voltage has been written into the gate-source of the second transistor and an initial voltage has been written into the first capacitor, a data voltage, which increases or decreases with a predetermined slope, is supplied through the data line.

11. The display panel of claim 6, wherein the pixel further comprises a second capacitor having one side connected to the gate of the fourth transistor, wherein, after the threshold voltage has been written into the gate-source of the fourth transistor, a reference voltage is inputted to the other side of the second capacitor, and wherein the level of a current flowing through the LED is controlled by the reference voltage.

12. The display panel of claim 6, wherein the pixel further comprises:

a connection control transistor having one side connected to the second transistor and the fourth transistor and an other side connected to the driving low voltage;

a fifth transistor configured to control connection of the gate and a drain of the second transistor;

a sixth transistor configured to control connection of a gate and a drain of the fourth transistor;

a first capacitor disposed between the gate of the second transistor and a data line;

a scan transistor configured to control connection of the first capacitor and the data line; and a second capacitor having one side connected to the gate of the fourth transistor and an other side through which a reference voltage is inputted.

13. The display panel of claim 12, wherein a control time for the pixel is divided into an initialization time, a program time, and a light emission control time and, during the initialization time, the first transistor, the second transistor and the sixth transistor are turned on and the scan transistor and the connection control transistor are turned off.

14. The display panel of claim 13, wherein, during the program time subsequent to the initialization time, the fifth transistor, the sixth transistor, the scan transistor and the connection control transistor are turned on and the first transistor is turned off.

15. The display panel of claim 14, wherein the light emission control time subsequent to the program time is divided into a plurality of sub-times and, during a first sub-time among the plurality of sub-times, the first transistor, the scan transistor, the connection control transistor and the fourth transistor are turned on and the fifth transistor and the sixth transistor are turned off.

16. The display panel of claim 6, wherein each of the first transistor, the second transistor, the third transistor and the fourth transistor is formed as a CMOS (complementary metal-oxide-semiconductor) type on a silicon backplane, the first transistor is a P-type transistor, and each of the second transistor, the third transistor and the fourth transistor is an N-type transistor.

17. The display panel of claim 6, wherein each of the first transistor, the second transistor, the third transistor and the fourth transistor is formed as an NMOS (N-channel metal-oxide-semiconductor) type on an oxide backplane.

18. A pixel driving device, with respect to which a pixel comprises a first path circuit comprising a first transistor and a second transistor disposed in series between a driving high voltage and a driving low voltage, a first node formed between the first transistor and the second transistor, and a first capacitor disposed between a gate of the second transistor and a data line, and a second path circuit comprising a third transistor and an LED disposed in series between the driving high voltage and the driving low voltage, a gate of the third transistor being electrically connected to the first node, to supply to the data line a data voltage, regarding which a ramp voltage, increasing or decreasing with a lapse of time, is formed in the gate of the second transistor and a start voltage of the ramp voltage is determined depending on a gray scale value of the pixel.

19. The pixel driving device of claim 18, wherein a control time for the pixel is divided into an initialization time, a program time, and a light emission control time, wherein an initial voltage corresponding to a gray scale value of the pixel is supplied as the data voltage during the program time, and wherein the data voltage is changed to a predetermined voltage, and subsequently, increased or decreased with a predetermined slope from the predetermined voltage during the light emission control time.

* * * * *